US005443708A

United States Patent [19]

Sitges Menendez et al.

[11] Patent Number: 5,443,708

[45] Date of Patent: Aug. 22, 1995

[54] CATHODE FOR THE ELECTROLYTIC DEPOSITION OF NON-FERROUS METALS

[75] Inventors: Francisco J. Sitges Menendez, Madrid; Fernando Sitges Menendez, Salinas; Francisco Alvarez Tamargo, Luanco; Ives Lefevre, Salinas; Jose M. Martinez Valdes, Arnao-Castrillon, all of Spain

[73] Assignee: Auturiana De Zinc, Spain

[21] Appl. No.: 245,564

[22] Filed: May 18, 1994

[30] Foreign Application Priority Data

Jun. 18, 1993 [ES] Spain ..... 9301366

[51] Int. Cl.[6] ..... C25C 7/02

[52] U.S. Cl. ..... 204/286; 204/280; 204/290 R

[58] Field of Search ..... 204/280, 286, 290 R

[56] References Cited

FOREIGN PATENT DOCUMENTS 3051150 4/1981 Germany .
1326418 8/1973 United Kingdom .

OTHER PUBLICATIONS

Translation of German DE 3051150C2; Apr. 1981; pp. 1–7.

*Primary Examiner*—Kathryn Gorgos
*Attorney, Agent, or Firm*—Ostrolenk, Faber, Gerb & Soffen

[57] ABSTRACT

A cathode for the electrolytic deposition of non-ferrous metals has a plate (1) which, starting from at least one of its vertical edges, is provided on both sides with coinciding zones (5) of dielectric material. The dielectric material is located where a number of penetrators that cause the upper edges of the deposited layers of zinc to detach contact the plate. The plate (1) is provided with a slot (7) that coincides with upper regions of the dielectric material. The slot has a flat piece (5) of dielectric material in it, equal in thickness to the plate (1) and with surfaces which are flat and coplanar with those of the plate (1). The piece (5) and the slot (7) are provided with mutually cooperating portions that prevent the movement of the piece in any direction.

5 Claims, 3 Drawing Sheets

CATHODE FOR THE ELECTROLYTIC DEPOSITION OF NON-FERROUS METALS

The present invention relates to a cathode for the electrolytic deposition of non-ferrous metals such as zinc, copper etc., and more particularly to a flat cathode consisting of an aluminium plate, designed particularly for the production of zinc.

BACKGROUND OF THE INVENTION

In the cathodes of the type described above, the aluminium plate is usually terminated along its upper edge in a bar which is thicker and longer than said edge. With this arrangement, the cathodes are situated in the electrolytic tanks with the aluminium plate in the vertical position where the bar acts as a head for supporting the cathode in the tank and for connecting the lifting apparatus which handles it.

During the process of electrolysis, the zinc is deposited progressively over the entire surface of the aluminium plate in the region which is submerged in the electrolytic tank.

Generally, the vertical edges of the aluminium cathode plate are coated with a protective dielectric material which prevents the zinc from being deposited on the vertical edges. In this way, the layers of zinc deposited on each surface of the aluminium plate are prevented from joining along the vertical edges of said plate.

The layer of zinc deposited on the cathodes adheres to the surface of the aluminium plate. The devices used to detach this layer include two vertically moving knives terminating in converging horizontal lower edges, angular in section and of approximately the same length as the width of the cathodes. To use these devices for detaching the plates of zinc from the cathode, one knife is situated on each side thereof, resting and pressing the edges of both knives against said surfaces, above the height reached by the deposits of zinc on the cathode. The knives are then moved downwards such that when their edges meet the layer of zinc deposited on each side of the cathode they carry out its separation.

This system has the drawback that knives erode the surfaces of the cathode over its entire height, making it unusable after a certain number of operations. Due to the high cost of the cathodes, this system of detaching the zinc is, therefore, inadequate.

An attempt to solve the above mentioned problems has been made by means of a system which includes two successive phases of action on the cathodes. During a first phase, the upper edge of the deposited layers of zinc are detached by means of a horizontally acting lateral penetrator, and during a second phase, the layers of zinc are pulled free entirely by means of two vertical knives. The lateral penetrator consists of two horizontal arms which have an acting end whose edge is in the form of a vertical angle wedge; said arms being able to move axially, one on each side of the cathode at the height of the upper edge of the deposited layer of zinc. Whilst these arms move, the acting end thereof presses against the surface of the cathode and causes the erosion and deterioration thereof.

In order to help the action of the lateral penetrator, the British patent No. 1,326,418 describes cathodes on which a pivoting piece made of a dielectric material is mounted on the upper part of one of the vertical edges, situated at the height of impingement and action of the penetrator, which corresponds to the height on the plate reached by the electrolyte in the tank. This piece is channelled and grips the cathode plate to which it is fixed by means of an axis which is perpendicular to said plate. The piece pivots about said axis between a lower position, in which it is coupled to and covers a certain region of the plate, as a prolongation of the protective profile of the vertical edges, preventing the zinc from being deposited thereon during the process of electrolysis, and an upper position in which said region is free and uncovered, enabling the arms of the lateral penetrator to move up to the surfaces of the cathode plate in this region and, as it continues to advance, meeting the edge of the zinc deposit in order to detach it. These cathodes have one fundamental drawback which derives from the need to rotate the pivoting piece from its lower position to its upper position each time that the zinc deposits are to be detached. As the cathode is introduced into the tank, the pivoting piece should occupy its lower position. The rotation of the pivoting piece and the conditions to which said piece is subjected cause the adjustment between the piece and the cathode, and fundamentally between the axis of rotation, to be lost and deteriorate in a relatively short period of time; the pivoting piece having to be raised by hand during the operation of detaching the zinc, with the corresponding increase in cost of the process in the form of labour and increase in the corrosion of the cathode sheet in this region.

The German patent DE-A-3051150 describes a cathode whose plate has a fixed coating made of an insulating material starting from one of the vertical edges, in the region where the lateral penetrators impinge and rest. This coating extends over regions which coincide with the surfaces of the plate and over the section of the intermediate vertical edge. The external surfaces of the coating are flat and coplanar with those of the plate, for which both surfaces of said plate are provided with undercuttings where the shape and depth of which determine the shape and thickness of the coating of insulating material for each side of the plate. To prevent this coating from separating from the cathode plate, the region in which the undercuttings for fixing said coating are made may be provided with through holes via which the coating layers on each of the surfaces of the plate are joined. This constitution has manufacturing problems due to the need to make the lowered regions on both surfaces of the cathode plate and the through holes between said regions and via which the coatings of both surfaces have to be joined. All of this implies a considerable increase in the cost of manufacture of the cathodes. Furthermore, due to the action of the lateral penetrators on the insulating coating, when they begin to act on the cathode, they cause the premature breaking of the joins between the coatings of each side, causing them to separate from the plate. Furthermore, the thickness of the insulating coatings is relatively reduced, and the action of the penetrators causes their premature deterioration, exposing part of the plate and thereby giving rise to irregular deposits of zinc which obstruct the action of the penetrators. This makes it necessary to carry out periodic revisions of the cathodes in order to replace the insulating coatings.

DESCRIPTION OF THE INVENTION

The object of the present invention is a cathode whose plate is provided with an insulating surface, in the region where the lateral penetrators impinge, starting from the corresponding vertical edge where the plate and insulating surface are constituted in such a way that the process of applying or assembling said surface can be carried out in a simple way so that the possible substitution of such a surface can be carried out in the same zinc producing plant, without having to resort to complicated devices or procedures.

A further object of the invention is a surface of an electrically insulating material, with the characteristics described in the claims, which is very durable and which is formed on the surface of the cathode plate with practically no affect on the cost thereof.

According to the present invention, the cathode plate is provided, starting from at least one of its edges perpendicular to the suspension bar, with a slot situated close to said bar coinciding with the region of impingement and rest of the horizontal penetrators which carry out the initial detachment of the upper edge of the layers of zinc deposited on both surfaces of the cathode plate. The height of this slot is greater than the width of the acting edge of the penetrators and is occupied by a flat piece of dielectric material which is acid resistant and of the same thickness as the plate. The piece of dielectric material is defined by flat surfaces which are coplanar with those of the cathode plate. The shape of the piece of dielectric material coincides with that of the slot.

This results in a cathode in which the insulating surfaces, situated in the regions where the lateral penetrators impinge, have considerable resistance since they are constituted by the insulating piece whose thickness is the same as that of the cathode.

Furthermore, the formation of the insulating surfaces by means of the piece of dielectric material enables, during the deposition phase, an edge of sufficient thickness, in the form of a cord, to be obtained, adjacent to said insulating surfaces and which facilitates the initial action of the penetrators.

In addition, the piece of dielectric material prevents the formation of undesirable deposits between the insulating material and the chamfers of the cathode plate.

The slot or slots of the cathode plate are provided with means of preventing the piece of dielectric material from moving, both in its own plane and in the direction perpendicular thereto, thereby ensuring its immobility and positioning in the slot of the plate.

BRIEF DESCRIPTION OF THE DRAWINGS

These characteristics, as well as other characteristics of the present invention, are described below in greater detail with reference to the accompanying drawings which show by way of a non-limiting example one practical embodiment thereof.

In the drawings.

DESCRIPTION OF A PREFERRED EMBODIMENT

Figure 1:
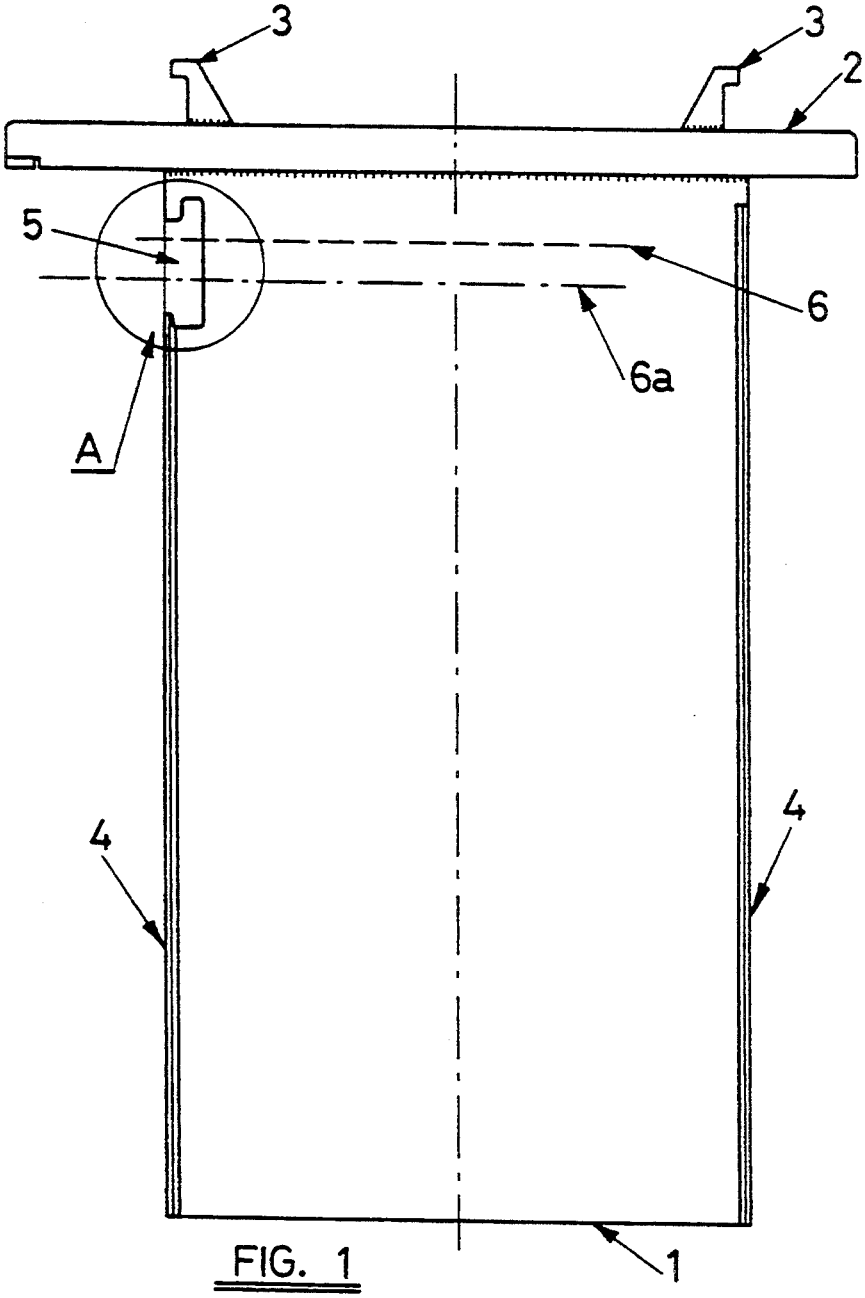
FIG. 1 is a front elevation of a cathode constituted according to the present invention.
Figure 2:
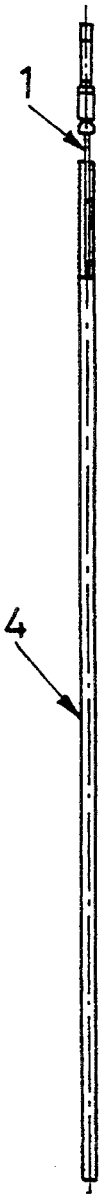
FIG. 2 is a profile view of the same cathode.

The cathode shown in FIGS. 1 and 2 includes a plate 1 rectangular in shape, made of aluminium, aluminium alloy, etc., and which has fixed on one of its transverse edges a bar 2 of greater length and width. This bar constitutes the head of the cathode and is used for supporting the cathode in the electrolytic tank and handling the cathode by means of lifting apparatus, for which it is provided with upper rings or hooks 3. The vertical edges of the plate are covered by means of a shape 4, made of a dielectric material, which prevents the zinc from being deposited on along these protected edges, such that the layers of zinc deposited on the surfaces of the plate 1 are not joined along these vertical edges. In this way, the zinc is deposited on the cathode on the free surfaces of the plate 1, forming two layers which are only joined together by their lower edge, around the lower edge of the plate 1.

Figure 3:
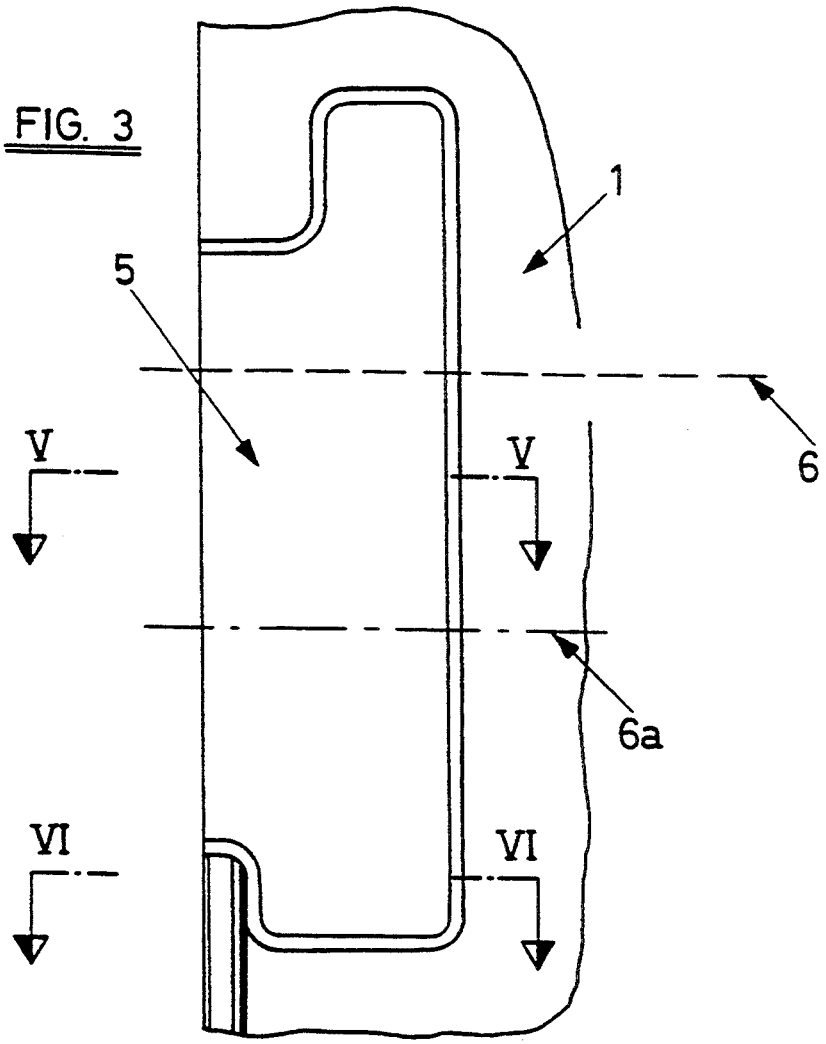
FIG. 3 corresponds to the detail A of FIG. 1 shown to a larger scale.
Figure 4:
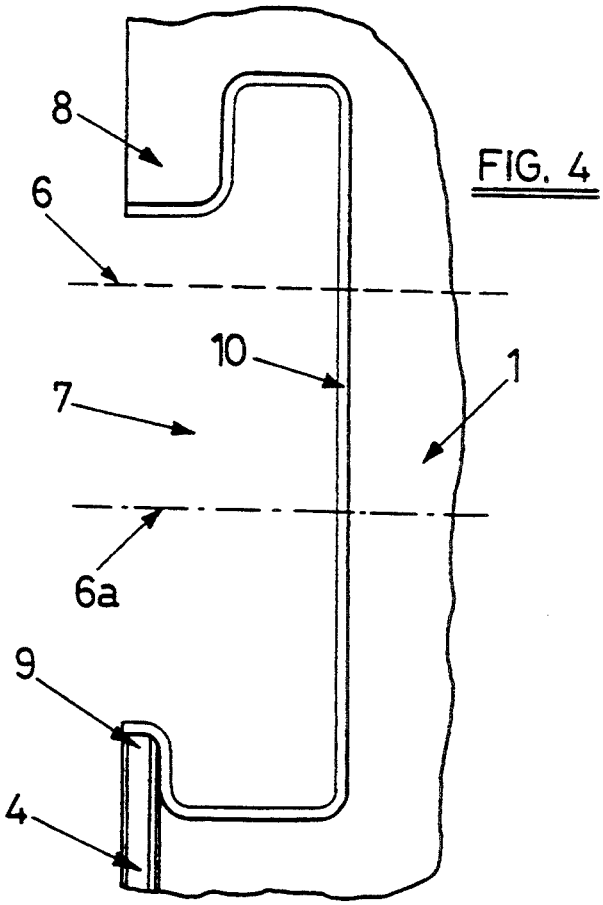
FIG. 4 is a view similar to that of FIG. 3 showing the cathode plate without the piece of insulating material.

The plate 1 is also provided, starting from one of its vertical edges, with a region 5 of dielectric surfaces which are resistant to the acids used in electrolytic processes. The region 5 is situated close to the head bar 2, coinciding with the region of impingement and rest of a number of transverse penetrators, not shown in the drawings, for detaching the upper edge of the deposited layers of zinc. The upper edge 6 of the layers of zinc deposited on the plate 1, represented by the broken line in FIGS. 1, 3 and 4, coincides with this region 5. Also shown is the axis *6a* of the transverse penetrators.

Figure 5:
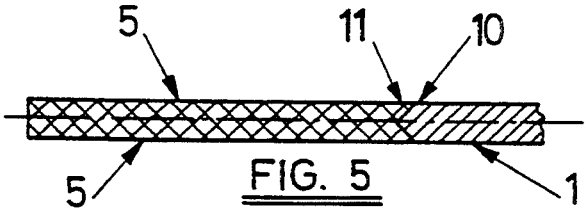
FIGS. 5 and 6 are sections taken along the lines V—V and VI—VI of FIG. 3 respectively.
Figure 6:
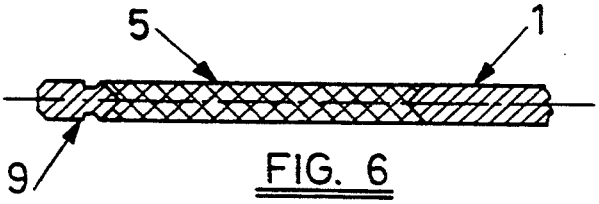

According to the present invention, the region 5 consists of a piece of plastic material which is acid resistant and equal in thickness to the plate 1. To mount this piece, a slot 7 is made in the plate 1, starting from one of its vertical edges, said slot adopting any configuration and having a height which is greater than the width of the acting edge of the horizontal penetrators by means of which the upper portion of the layer of zinc deposited on the cathode is detached. The mouth of the slot 7 has a narrowing defined by the portions 8 and 9 which define opposing partial closures. The shape of the piece 5 coincides with that of the opening 7 such that it is prevented from separating or coming out of the plate by the portions 8 and 9. Furthermore, the shapes of the opposing edges of the piece 5 and the slot 7 are mutually matched. In the example shown in the drawings, the edge 10 which defines the opening 7 is provided with chamfered edges, starting from both surfaces of the plate 1, defining a convex angular section, as shown in FIGS. 5 and 6. The piece 5 is provided on its opposing edge with a channel which is concave and angular in section and which can be coupled to the angular edge 10.

This system of matching or coupling between the two opposing edges of the piece 5 and the slot 7 prevents said piece from moving transversely relative to the plate 1.

In this way, the piece 5 of dielectric plastic material is deprived of all movement relative to the cathode plate 1.

As has been indicated above, the piece 5 is equal in thickness to the plate 1, such that the major surfaces of said plate are coplanar with the surfaces of the plate 1, as can be seen in FIGS. 5 and 6.

With the characteristics described, regions 5 of dielectric material are obtained starting from the vertical edge of the plate 1 on which the horizontal penetrators impinge; said regions preventing the deposition of zinc. The penetrators slide easily over the surfaces of the piece 5 until they reach the layers of zinc which are deposited on the surfaces of the plate 1, causing them to separate from said plate; this operation being helped by the formation of cords whose edges are adjacent to the piece 5.

The piece 5 may be molded directly onto the shape of the opening 7 or be formed by two halves obtained according to the mid-plane parallel to the major surfaces of said piece. In the latter case, each of the two halves is joined on one side to the shape of the opening 7 and they are joined together by any system, for example by means of an acid resistant adhesive, thermo-welding, etc.

The plate 1 may be provided with a slot 7 starting from each of its vertical edges, each of the two slots being occupied by pieces 5.

We claim:

1. A cathode for the electrolytic deposition of non-ferrous metals, comprising:

an aluminum plate of rectangular shape, the plate having opposite first and second surfaces and having a first edge with a supporting bar at the first edge, and a pair of second edges meeting the first edge, dielectric material at one of the second edges, the dielectric material having an end region, penetrators for detaching deposited layers of zinc from the surfaces of the plate, a slot into said one of the second edges of the plate, the slot extending from the first surface of the plate to the second, opposite surface, an opening into the slot at the corresponding second edge of the plate and an edge of the opening at the end region of the dielectric material, said slot having a height which is greater than a width of the penetrators, a flat piece of acid resistant dielectric material in the slot extending from the first surface of the plate to the second surface, and having opposite surfaces which are coplanar with the respective surfaces of said plate, said piece corresponding in shape to the slot, and the slot is provided with means of preventing movement of said piece.

2. A cathode according to claim 1, wherein the means of preventing movement of the piece includes a narrowing on both sides of the opening of the slot, and a matching coupling between opposing edges of said piece and opposing edges of the slot.

3. A cathode according to claim 2, wherein the matching coupling is angular in section, with a convex shape along the slot and a concave shape along the opposing edge of the piece.

4. A cathode for the electrolytic deposition of non-ferrous metals, comprising:

a metal plate having opposite first and second surfaces and having a first edge with a supporting bar disposed at the first edge, and a pair of second edges meeting the first edge, a slot into one of the second edges of the plate, the slot extending from the first surface of the plate to the second, opposite surface of the plate, a dielectric material insert in the slot and extending from the first surface of the plate to the second surface of the plate, and having opposite surfaces which are coplanar with the respective surfaces of said plate, means retaining said insert in the slot.

5. A cathode according to claim 1, further comprising dielectric material at at least one of the second edges.

* * * * *

UNITED STATES PATENT AND TRADEMARK OFFICE

CERTIFICATE OF CORRECTION

PATENT NO. : 5,443,708

DATED : Aug. 22, 1995

INVENTOR(S) : Francisco Javier SITGES MENENDEZ et al.

It is certified that error appears in the above-indentified patent and that said Letters Patent is hereby corrected as shown below:

On title page, item

[73] Assignee: Asturiana de Zinc, Spain

Signed and Sealed this

Twenty-seventh Day of February, 1996

*Attest:*

Bruce Lehman

BRUCE LEHMAN

*Attesting Officer*

*Commissioner of Patents and Trademarks*